US005857877A

United States Patent [19]

Hotea et al.

[11] Patent Number: 5,857,877

[45] Date of Patent: Jan. 12, 1999

[54] RECEPTACLE CONTAINER FOR PRESSED SCREEN CONTACT PINS

[75] Inventors: Gheorghe Hotea, Griesheim; Marianne Eva Modler, Langen, both of Germany

[73] Assignee: The Whitaker Corporation, Wilmington, Del.

[21] Appl. No.: 836,566

[22] PCT Filed: Nov. 9, 1995

[86] PCT No.: PCT/IB95/00991

§ 371 Date: May 9, 1997

§ 102(e) Date: May 9, 1997

[87] PCT Pub. No.: WO96/17407

PCT Pub. Date: Jun. 6, 1996

[30] Foreign Application Priority Data

Nov. 28, 1994 [GB] United Kingdom ..... 9424117

[51] Int. Cl.[6] ..... H01R 11/09

[52] U.S. Cl. ..... 439/787; 439/851

[58] Field of Search ..... 439/850, 851, 439/723, 724, 787, 786

[56] References Cited

U.S. PATENT DOCUMENTS 4,753,616 6/1988 Molitor ..... 439/851
5,197,906 3/1993 Watanabe et al. ..... 439/850
5,383,800 1/1995 Saka et al. ..... 439/787

FOREIGN PATENT DOCUMENTS 0 566 038-A1 10/1993 European Pat. Off. .
8815178.6-U1 3/1989 Germany .
2 265 769 10/1993 United Kingdom .

*Primary Examiner*—Gary F. Paumen
*Attorney, Agent, or Firm*—Driscoll A. Nina

[57] ABSTRACT

An electrical terminal (2) comprises a pin receiving contact section (8) and a pin mounting section (4). The receptacle terminal (2) is for mounting to pins stamped from pressed screens of automobile fuse and relay boxes, to adapt pin terminals thereof into receptacle terminals for certain connections. The pin mounting section (4) comprises a bottom wall (40), side walls (42, 44) and top half-walls (46, 48) that are bent into a U-shape and have free edges (56) directed towards the bottom wall (40). This U-shape provides for very stiff top walls with respect to outward forces on the side walls. The corners between adjacent walls are provided with slots (64, 62, 68, 66) to allow formation of inwardly bent contact and mounting arms (72, 74) that form a pin receiving contact cavity therebetween. The mounting portion thus provides very high contact forces for secure mounting to a pin terminal, yet the slots allow sufficient flexibility to ensure that sufficient flexibility is provided to the mounting portion to avoid plastic deformation due to thermal and mechanical solicitation particularly when considering use in automotive applications.

9 Claims, 1 Drawing Sheet

RECEPTACLE CONTAINER FOR PRESSED SCREEN CONTACT PINS

BACKGROUND OF THE INVENTION

1. Field of the Invention

This invention relates to a receptacle contact for mounting to contact pins to adapt the contact pins to a receptacle contact e.g. for use with pressed screen pin contacts.

2. Summary of the Prior Art

Fuse and relay boxes of automobiles often comprise pressed screen contact sheets from which flat tab contacts are stamped. The pressed screens are flat sheets of metal out of which a multitude of circuits are stamped for interconnecting various components to fuses and relays. Tabs are stamped, usually orthogonally, from the press screen for connection of the circuits thereof to connectors of cable assemblies leading to various components of the vehicle. Many different types of contacts need to be connected to the various circuits of the press screen, depending on the electric current requirements and the available space. It is easy to stamp pin and tab contacts from such press screens, however certain receptacle contacts, particularly miniature receptacle contacts having closed box-shaped bodies, are very difficult to produce directly from the press screen. In certain cases it is necessary to have receptacle contacts on the press screen and these can be assembled to tab or pin contacts on one end and provide a receptacle contact at the other end for connection to complementary pin or tab contacts of connectors.

It is of course a continuous requirement to produce such receptacle contacts in the most compact and cost-effective manner that can be quickly, easily, and safely assembled to the pressed screen. It is also often desirable to produce miniature receptacle contacts for pressed screens that can receive pin contacts with good electrical characteristics therebetween.

SUMMARY OF THE INVENTION

It is therefore an object of this invention to provide a miniature receptacle contact for adapting pin contacts into receptacle contacts in a cost-effective, reliable and compact manner.

The object of this invention has been achieved by providing a receptacle contact having a pin mounting section extending axially into a complementary pin contact section, wherein the mounting section comprises a bottom wall, a pair of side walls extending from lateral edges thereof, and a pair of top half-walls extending from the side walls towards each other and forming a seam therebetween, each of the walls having contact protrusions extending inwardly for forming a pin receiving cavity for tightly receiving a pin therein, the side walls separated from the bottom wall by axially extending slots and the side walls separated from the top half walls by axially extending slots, the slots enabling inward deformation of the mounting portions. Embodiments may include provision of U-shaped top half walls having their free ends directed into the mounting section towards the bottom wall thereby forming a contact surface opposing the bottom wall contact surface for tightly receiving the complementary pin contact therebetween.

DETAILED DESCRIPTION OF THE PREFERRED EMBODIMENT

Figures 1, 2, 3, 4, 5, 6:
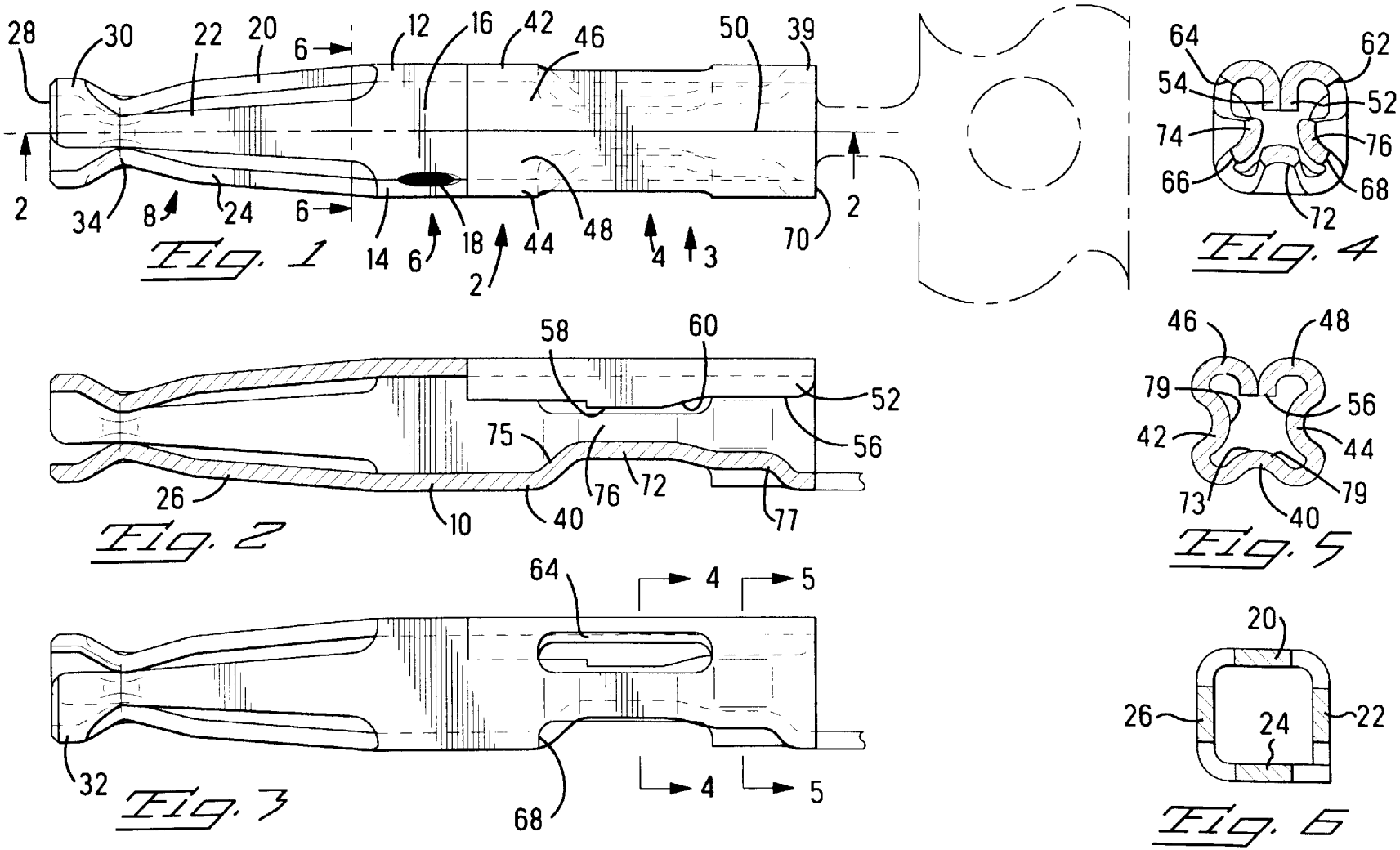
FIG. 1 is a top view of a receptacle terminal for mounting to a pin terminal.
FIG. 2 is a cross-sectional view through lines 2—2 of FIG. 1.
FIG. 3 is a view in the direction of arrow 3 of FIG. 1.
FIG. 4 is a cross-sectional view through lines 4—4 of FIG. 3.
FIG. 5 is a cross-sectional view through lines 5—5 of FIG. 3.
FIG. 6 is a cross-sectional view through lines 6—6 of FIG. 1.

Referring to FIGS. 1–6, an electrical receptacle contact 2 comprises a pin mounting section 4 extending axially into a box-shaped body section 6 which extends axially into a pin receiving contact section 8. The body section 6 comprises a bottom wall 10, side walls 12 and 14 extending substantially orthogonally from lateral edges thereof and a top wall 16 extending from one side of the wall 12 towards the other side wall 14 and attached thereto by a laser weld 18. Contact arms 20,22,24 and 26 extend from the top, side and bottom walls 16,12,14 and 10 respectively towards a pin-receiving mating end 28. The pair of adjacent contact arms 20,22 extending from the side and top walls 12,16 respectively are joined together by an L-shaped joining section 30 at the mating end 28. Similarly, the side and bottom contact arms 24,26 extending from the side and bottom walls 14,10 are joined together by an L-shaped joining section 32 proximate the mating section 28. Axially rearwards but proximate the joining sections 30, the contact arms 20 are inwardly bent to form contact portions 34 for receiving a pin contact therebetween and making contact with four contact points, each contact point provided on each of the contact arms 20,22, 24,26.

The mounting section 4 extends axially rearwards from the body section 6 to a pin receiving section (29) at the pin receiving end (70), and comprises a base wall 40, side walls 42,44 extending substantially orthogonally therefrom, each side wall 42,44 having a top half-wall 46,48 respectively extending from upper edges thereof towards each other, abutting along the central axially extending seam 50. At the seam 50 the top half-walls 46,48 have extensions 52,54 that have free edges 56 directed towards the bottom wall 40. The edges 56 are provided with protrusions 58 extending further towards the bottom wall 40 and joined to a front portion of the edge 56 by a smooth tapered lead-in portion 60. The top half-walls 46,48 are separated along a certain axial length from their respective adjacent side walls 42,44 by oblong cutouts 62,64 respectively. Similarly, the side walls 42,44 and the bottom wall 40 are separated along a certain length by oblong slots 66,68 respectively. The cutouts 62,64,66,68 extend substantially centrally between the body section 6 and a pin receiving end 70 of the terminal 2. The cutouts 62—68 enable adjacent wall portions of the mounting section, in particular of the bottom and side walls to be inwardly deformed thereby forming inwardly protruding mounting portions 72,74,76 of the bottom and side walls 40,42,44 respectively. The mounting portions 72,74,76 and the top wall protrusions 58 thus form a substantially square pin receiving portion for tightly receiving a pin between four contact surfaces for secure mounting and electrical contact thereto.

The pin receiving section 39 has a closed inner periphery 73 (see FIG. 5) with inwardly deformed arcuate wall portions 79 on the side and bottom walls 42,44,40 and a closed seam 50 that provides a strong and rigid guide portion for entry of the pin contact thereinto. Furthermore, this rigid configuration provides a strong, rigid support for the contact arms 72,74,76 and contact edges 58. Due to the inwardly deformed arcuate wall portions 79, the top half-walls 48,46 can be pre-stressed for resiliently abutting each other at the seam 50 to further increase the rigidity and strength of the mounting section 4.

Due to the attachment of the mounting portions 72,74,76 at both ends 75,77 to the bottom and side walls, and due to their inward deformation, they provide contact arms with high contact force but nevertheless sufficient resiliency to avoid plastic deformation and relaxation of the mounting portion when mounted to a pin terminal. The latter is important when considering the mechanical and thermal solicitation that such connections may be subject to when utilized for example in an automobile. The mounting portion must hold very strongly to the contact pins, but simultaneously have certain resiliency in order to avoid overstressing, leading to plastic deformation and relaxation of the mounting portion to the pin. The strength of the mounting portion is further enhanced by the U-shaped half top walls 46,48 whereby the free edges 56 are inwardly directed thereby providing high rigidity not only in the vertical plane extending between the seam 50 and the bottom wall 40, but also rigidifies the mounting portion with respect to forces outwardly biasing the side walls 42,44 due to the U-shaped structure of the half top walls. Furthermore, due to the rigid but very simple structure, and low use of material, this design is very sturdy yet cost effective, easy to mount to a pin terminal and reliably held and electrically contacted thereto due to the sufficient strength but also sufficient flexibility of the mounting portions by provision of the oblong cutouts.

Advantageously therefore, the contact mounting portion is simple, cost-effective to manufacture and assemble, and reliable for adapting pin terminals to receptacle terminals, especially those subject to mechanical and thermal solicitation such as for use in automobiles.

We claim:

1. A stamped and formed electrical receptacle terminal comprising a box-shaped body section from which extends a contact section for mating with a complementary pin terminal wherein the terminal further comprises a mounting portion extending from the body section, for electrically and mechanically connecting the terminal to a pin contact, the mounting portion comprising a base wall, opposed side walls and top half-walls opposed to the base wall, the top half-walls extending towards each other and forming a seam therebetween, wherein free edges of the top half-walls are bent inwardly towards a contact protrusion formed from the base wall; the side walls also having opposed contact protrusions; whereby the base wall and sidewalls contact protrusions and the top wall free edges form a mounting cavity for tightly receiving the pin contact therein.

2. The terminal of claim 1 wherein the top half-walls have U-shaped cross-sectional profiles, where the cross-section is taken orthogonally to the direction of mating with the pin contact.

3. The terminal of claim 1 wherein the mounting portion extends in a direction substantially opposed and aligned with the contact section.

4. The terminal of claim 1 wherein oblong cut-outs extending in the direction of insertion of the contact pin in the mounting cavity are provided between adjacent walls and flank the contact protrusions for increased flexibility thereof.

5. The terminal of claim 1 wherein the top half-wall free edges comprise contact protrusions extending towards the base wall contact protrusion for contacting the contact pin thereagainst.

6. The terminal of claim 4 wherein the oblong cutouts are substantially centrally positioned between the body section and a pin receiving end of the mounting section.

7. The terminal of claim 1 wherein the mounting section extends axially between a pin receiving end and the body section, and has a pin receiving section at the pin receiving end that has a closed cross-sectional inner periphery for receiving and guiding the pin contact, and furthermore to strengthen and rigidify the mounting section.

8. The terminal of claim 1 wherein the side and bottom walls are inwardly arcuately deformed for rigidification and strengthening thereof.

9. The terminal of claim 1 wherein the top half-walls are prestressed and abut each other such that the seam is closed and under compressive forces.

* * * * *

UNITED STATES PATENT AND TRADEMARK OFFICE

CERTIFICATE OF CORRECTION

PATENT NO. : 5,857,877

DATED : January 12, 1999

INVENTOR(S) : Gheorghe Hotea et al.

It is certified that error appears in the above-identified patent and that said Letters Patent is hereby corrected as shown below:

On the title page, Item [54] should read

-- [54] Receptacle Contact For Pressed Screen Contact Pins --.

Signed and Sealed this

Sixth Day of July, 1999

*Attest:*

Q. TODD DICKINSON

*Attesting Officer*

*Acting Commissioner of Patents and Trademarks*